US006130649A

United States Patent [19]

Wojtkowiak et al.

[11] Patent Number: 6,130,649

[45] Date of Patent: Oct. 10, 2000

[54] POLARIZER FOR EXCITING AN ANTENNA

[75] Inventors: Daniel Wojtkowiak, Neustadt; Karl-Heinz Reimann, Langenhagen; Hans-Peter Quade, Hannover, all of Germany

[73] Assignee: Alcatel, Paris, France

[21] Appl. No.: 09/145,753

[22] Filed: Sep. 2, 1998

[30] Foreign Application Priority Data

Sep. 24, 1997 [DE] Germany ..... 197 41 999

[51] Int. Cl.[7] ..... H01Q 13/02

[52] U.S. Cl. ..... 343/786; 343/772; 343/775; 343/840

[58] Field of Search ..... 343/756, 772, 343/776, 840, 850, 786, 779, 775; H01Q 13/02

[56] References Cited

U.S. PATENT DOCUMENTS

| | | | |
|---|---|---|---|
| 3,696,434 | 10/1972 | Sciambi, Jr. | 343/850 |
| 3,864,688 | 2/1975 | Hansen et al. . | |
| 4,077,039 | 2/1978 | Ren et al. . | |
| 4,258,366 | 3/1981 | Green . | |
| 4,797,681 | 1/1989 | Kaplan et al. . | |
| 5,276,456 | 1/1994 | Kim . | |
| 5,434,585 | 7/1995 | Harris | 343/786 |

FOREIGN PATENT DOCUMENTS

| | | |
|---|---|---|
| 14 91 921 | 7/1977 | Germany . |
| 41 13 760 | 11/1992 | Germany . |
| 295 11 273 U | 11/1995 | Germany . |
| 32 41 890 | 2/1998 | Germany . |
| 767518 | 2/1957 | United Kingdom . |
| 21 17 980 | 10/1983 | United Kingdom . |
| 21 75 145 | 11/1986 | United Kingdom . |
| 21 94 859 | 3/1988 | United Kingdom . |

OTHER PUBLICATIONS

Anton Boifot, "Classification of Ortho–Mode Transducers," in *European Transactions on Telecommunications & Related Technologies*, Ass'n Elettrotecnica ed Elettronica Italia, Milan, Italy, vol. 2, No. 5, pp. 503–510, Sep.–Oct. 1991 (ISSN 1120–3862).

*Primary Examiner*—Don Wong
*Assistant Examiner*—Shih-Chao Chen
*Attorney, Agent, or Firm*—Ware, Fressola, Van der Sluys & Adolphson LLP

[57] ABSTRACT

A polarizer for exciting the parabolic reflector of a directional antenna includes a profile section (7) which is formed as a waveguide and is adapted to simultaneously transmit two linearly polarized orthogonal electromagnetic waves. Two rectangular waveguides which separately guide the two electromagnetic waves are connected to the profile section (7). The end face of one of the rectangular waveguides is connected to the side wall of the profile section (7) in a radial direction, whereas the other rectangular waveguide is connected to an end face of the profile section (7). Both rectangular waveguides have an electromagnetic connection to the profile section (7) via openings, wherein a short-circuiting element (10) is disposed in the profile section (7) between the openings. Separate tuning elements are made unnecessary by locating a first transition section which is formed as a cavity (11) and has a generally rectangular cross-section, between the radially connected rectangular waveguide and the respective opening (9). Two opposing mutually aligned ribs (12, 13) which extend along the axial direction and project from the wider walls of the cavity (11) are arranged in the first transition section. In addition, a second transition section (8), which is stepped and encloses a cavity with a generally rectangular cross-section, is located between the profile section (7) and the rectangular waveguide (4). The second transition section (8) is connected to the end face of the profile section (7), wherein the end face of the rectangular waveguide is connected to the second transition section (8).

4 Claims, 2 Drawing Sheets

POLARIZER FOR EXCITING AN ANTENNA

BACKGROUND OF THE INVENTION

1. Technical Field

The invention relates to a polarizer for exciting the parabolic reflector of a directional antenna which includes a profile section which is formed as a waveguide and adapted to simultaneously transmit two linearly polarized orthogonal electromagnetic waves. Two rectangular waveguides separately guide the two electromagnetic waves and are connected to the profile section. The end face of one of the rectangular waveguides is connected to the side wall of the profile section in the radial direction, whereas the other rectangular waveguide is connected to an end face of the profile section. Both rectangular waveguides are electromagnetically connected to the profile section via openings, with a short circuit element disposed in the profile section between the openings.

2. Description of the Prior Art

Directional antennae are used for wireless transmission of electromagnetic waves from one location to another location and employed with, for example, microwave radio links, satellite communication and radio position fixing. Their efficiency has to be as high as possible. Directional antennae are equipped with primary radiators and must strongly attenuate the side lobes in the interfering directions and provide good matching and high gain. The primary radiators are typically equipped with a feed horn and located in the focal point of parabolic antenna. However, the antenna can also be a so-called backfire antenna equipped with a subreflector. Some conventional antennae can also handle two electromagnetic waves which are separated from each other. Such antennae employ a polarizer which is connected to two feed lines which separately carry the two waves.

A polarizer of this type, which is simultaneously the primary radiator, is known from U.S. Pat. No. 3,864,688. The two feed lines therein are formed as rectangular waveguides and are connected coplanarly to the tubular polarizer. This configuration allows the two feed lines to be arranged sequentially in the same plane. This type of arrangement, however, has the disadvantage that the polarizer, which is to separate the two waves, requires complex and precise machining because one wave must be rotated by 90° without being reflected and interfering with the other wave. To accomplish this, the conventional polarizer has pins or a twisted sheet metal strip which are located between the two feed locations of the two waveguides pins and which are offset in both the axial and the circumferential direction.

In the polarizer described in DE 32 41 890 C2, and corresponding U.S. Pat. No. 4,584,588, which is also used as a primary radiator, the two waves are separated with a simpler device. Here, one of the flat sides of the second rectangular waveguide is connected to the end face of the polarizer. The end face is closed off by the second rectangular waveguide. Consequently, the two rectangular waveguides are connected to the polarizer so that polarization direction of one waveguide is offset by 90° with respect to the other waveguide. The two waves are thus fed orthogonal to each other and are therefore completely decoupled. No additional components are required. Adjustable tuning or trimming elements 9, 10 are employed to couple the waves in and out while minimizing reflections.

SUMMARY OF THE INVENTION

It is the object of the invention to provide a simpler polarizer of the type described above.

This object is solved by the invention in that between the rectangular waveguide which is radially connected to the profile section, and the associated opening, there is located a first transition section which has the form of a cavity with a rectangular cross-section and includes two opposing mutually aligned ribs which extend along the axial direction and project from the wider walls of the cavity, and between the profile section and the rectangular waveguide which is connected to the face of the profile section, there is located a second transition section which has a stepped profile and which encloses a cavity with a generally rectangular cross-section, wherein the end face of the rectangular waveguide is connected to the second transition section.

The polarizer is simple to manufacture. Before the two rectangular waveguides are attached, the two transition sections in the profile section have to be shaped and connected to the profile section, respectively. The two rectangular waveguides can then be connected directly to the profile section and the second transition section, respectively, without requiring additional components. With the two transition sections, the waves can be coupled into and out of both rectangular waveguides with low reflection losses. No additional tuning is required. Consequently, separate tuning elements can be eliminated.

The invention will be fully understood when reference is made to the following detailed description taken in conjunction with the accompanying drawings.

DETAILED DESCRIPTION OF THE INVENTION

Figure 1:
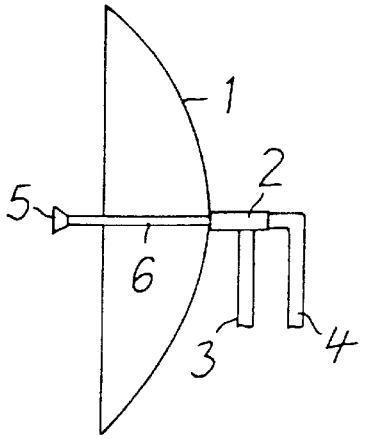
FIG. 1 is a schematic view of an antenna with a polarizer according to the invention.

Reference numeral 1 designates the reflector of a parabolic antenna which in the illustrated embodiment is a so-called "backfire antenna". The reflector 1 has a polarizer 2 which is described in more detail in FIGS. 2 to 7. Two rectangular waveguides 3 and 4—subsequently called the "first waveguide 3" and "second waveguide 4"—are connected to a transmission and receiving unit and are also connected to the polarizer 2. The primary radiator 5 is constructed as a subreflector and is also connected to the polarizer 2 via a waveguide 6. Alternately, the reflector 1 can also be excited directly by the polarizer 2, which is not shown in the drawings.

Figure 2:
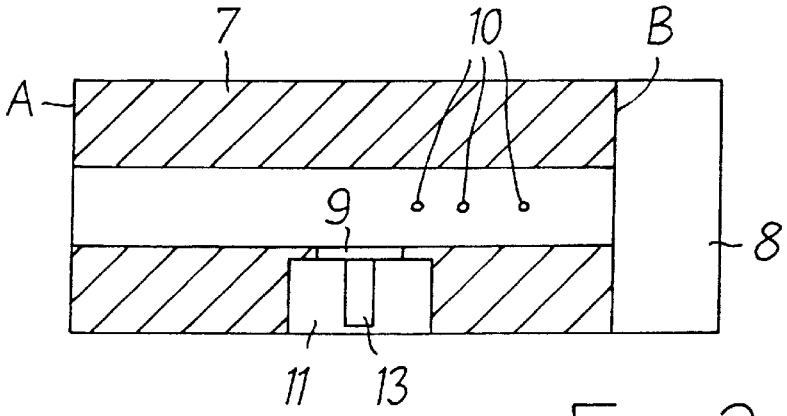
FIG. 2 is a side view of the polarizer in partial section with the connected second transition section.

FIG. 2 shows the polarizer 2 in greater detail. In the present example, the polarizer 2 has a quadratic cross-section and comprises a profile section 7 which encloses a waveguide. The enclosed waveguide can have a circular or square cross-section. The waveguide 6 is connected to one end A of the profile section 7, while a second transition section 8 is attached to the other end B to the profile section 7. The design of the second transition section 8 is illustrated in greater detail in FIG. 7. The first waveguide 3 is connected to the profile section 7 in such a way that the end face of the waveguide 3 is secured to the wall of the profile section 7 so as to point radially inwardly. The end face of the second waveguide 4 is connected to the free end of the second transition section 8. The second waveguide 4 is rotated by 90° relative to the first waveguide 3 at its connection point to the profile section 7.

Figure 3:
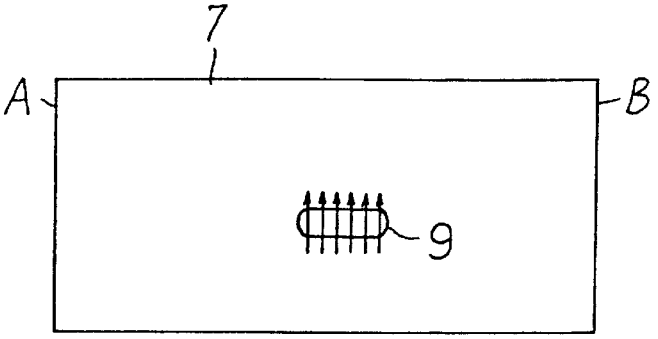
FIGS. 3 and 4 are schematic side and end views of the polarizer of FIG. 2 and illustrating the polarization directions of the two electromagnetic waves.
Figure 4:
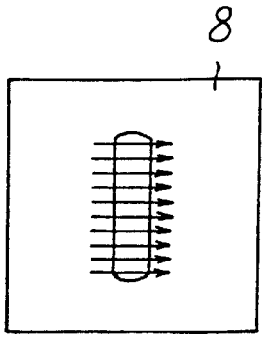

An opening in the form of an aperture 9 is provided in the wall of the profile section 7 where the first waveguide 3 is connected. With the described placement of the waveguides 3 and 4 on the profile section 7, the polarization directions of the two electromagnetic waves, which are fed separately via the two waveguides into the waveguides of profile section 7, are rotated by 90° with respect to each other, as indicated by the arrows in FIGS. 3 and 4. For clarity, only aperture 9 is shown in FIG. 3. An end view of the second transition 8 is illustrated in FIG. 4. The two waves, which are guided by the waveguides 3 and 4, are perfectly decoupled during feeding and therefore do not require separate elements for decoupling inside the waveguide of the profile section 7. The elements placed on or inside the profile section 7 are provided so that the waves are guided without reflection and interference losses.

For example, a short-circuiting element comprising, for example, pins 10 can be provided between the connection points of the two waveguides 3 and 4 and/or between the aperture 9 and the second transition section 8. The short-circuiting element can also be made of sheet metal. The wave which is fed from the first waveguide 3, then propagates only in the direction towards the open end A of the profile section 7.

Transition sections are located between the points where the two waveguides 3 and 4 are connected, and the waveguide of the profile section 7 to minimize reflections when the waves are coupled into the waveguide. These transition sections are shown at a greater detail in FIGS. 5 to 7.

Figure 5:
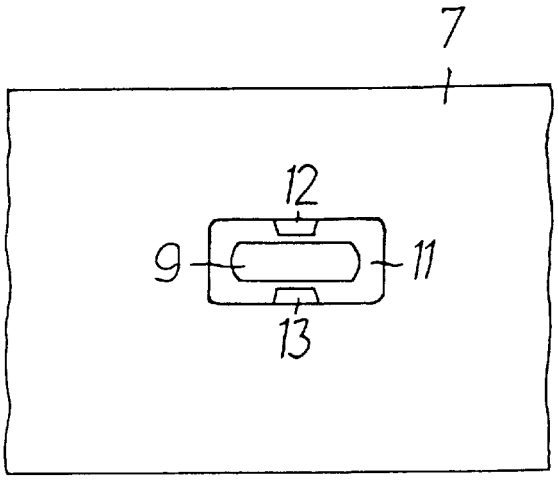
FIG. 5 is a partial side view of the polarizer showing the first transition section.
Figure 6:
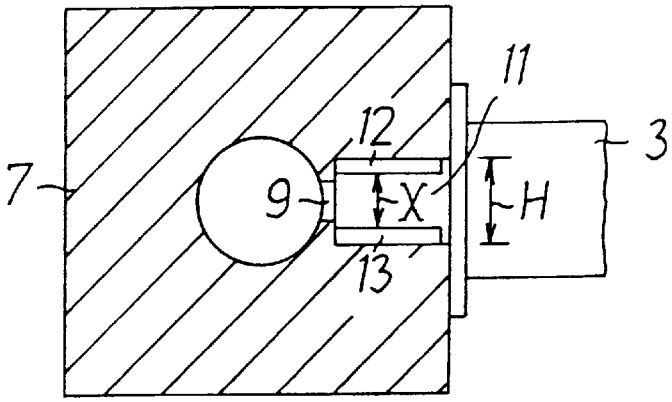
FIG. 6 is a cross-sectional view of the polarizer in the area of the first transition section and having the first waveguide connected thereto.

The first transition section according to FIGS. 5 and 6 is provided for the first waveguide 3 and comprises a cavity 11 having a generally rectangular cross-section with aperture 9 located at the end of the cavity 11. "Generally rectangular" means that the corners do not have to meet at right angles. The corners can be rounded to facilitate machining. Two opposing ribs 12 and 13 are attached to the inside the cavity 11 and project outwardly from the wider walls of the cavity 11. The ribs 12 and 13 are aligned with each other and extend in the axial direction of the cavity 11. The spacing X between the ribs 12 and 13 is preferably between 50% and 90% of the height H of the cavity 11 as defined by the shorter walls. The axial lengths of the ribs 12 and 13 is determined by the wavelength $\lambda$ of the wave which is guided inside the first waveguide 3. The ribs 12 and 13 do therefore not necessarily extend over the entire length of the cavity 11 and have a length of preferably between 0.25 $\lambda$ and 0.5 $\lambda$. The first waveguide 3 is directly connected to the cavity 11 as indicated in FIG. 6.

Figure 7:
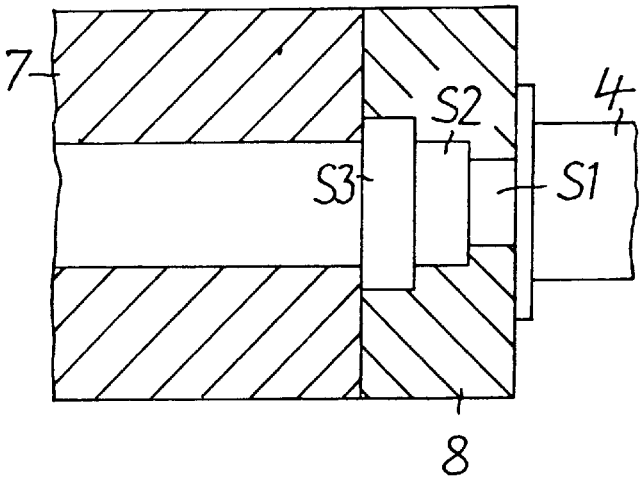
FIG. 7 is a cross-sectional view of the polarizer in the area of the second transition section and having the second waveguide connected thereto.

The second transition section 8 according to FIG. 7 is located between the second waveguide 4 and the profile section 7, with the enclosed waveguide forming the opening for coupling in the wave. The transition section 8 is formed as a stepped transition; such stepped transition regions are typically used to connect, for example, a rectangular waveguide to a circular or square waveguide. Like the cavity 11, the second transition section 8 also has a generally rectangular cavity. The individual steps have a rectangular cross-section with rounded corners. In the illustrated embodiment, the second transition section 8 has three steps S1, S2 and S3. The end face of the second waveguide 4 is directly coupled to the second transition section 8. In a preferred embodiment, the center axis of the second waveguide 4 coincides with the center axis of the profile section 7. The second waveguide 4 can also be attached to the second transition section 8 in an offset position. In this case, its center axis is offset relative to the center axis of the profile section 7 in the direction of the E-field.

The profile section 7 depicted in FIG. 2 can be manufactured with tight tolerances in a single piece, for example, from a galvanoplastic material, so that the waves are fed with even lower reflection losses.

The aforedescribed polarizer 2 is illustrated for the case where two waves are to be transmitted simultaneously, i.e. radiated from the reflector 1. However, the polarizer 2 can also be used for simultaneously receiving two waves with polarization directions which are orthogonal to each other. Alternately, the polarizer 2 can be used to simultaneously receive and transmit each of these waves.

The embodiments described above admirably achieve the objects of the invention. However, it will be appreciated that departures can be made by those skilled in the art without departing from the spirit and scope of the invention which is limited only by the following claims.

What is claimed is:

1. A polarizer for exciting the parabolic reflector of a directional antenna, comprising:

(a) a profile section which is formed as a waveguide and adapted to simultaneously transmit first and second linearly orthogonally polarized electromagnetic waves, the profile section having first and second openings therein;

(b) a short-circuit element disposed in the profile section between the first and second openings;

(c) a first transition section communicating with the first opening of the profile section, the first transition section defining a first cavity with a generally rectangular cross-section, and having two opposing mutually aligned ribs which extend in an axial direction of the first cavity and project from wider walls of the first cavity;

(d) a first rectangular waveguide electromagnetically connected to the first opening of the profile section by the first transition section to guide the first electromagnetic wave, wherein an end of the first rectangular waveguide is connected to a side wall of the profile section in a radial orientation;

(e) a second transition section communicating with the second opening of the profile section and being positioned at a front end of the profile section, the second transition section being formed with a plurality of steps and defining a second cavity with a generally rectangular cross-section; and (f) a second rectangular waveguide electromagnetically connected to the second opening of the profile section by the second transition section to guide the second electromagnetic wave, wherein an end of the second rectangular waveguide is connected to the second transition section, and a center axis of the second rectangular waveguide coincides with a center axis of the profile section.

2. The polarizer of claim 1, wherein the first cavity has shorter walls defining a height of the first cavity, the two ribs are separated by a space which is in a range of between 50% to 90% of the height of the first cavity.

3. The polarizer according to claim 2, wherein each of the two ribs has an axial length which is in a range of between 0.25 times and 0.5 times of a wavelength of the first electromagnetic wave guided in the first rectangular waveguide.

4. The polarizer according to claim 1, wherein each of the two ribs has an axial length which is in a range of between 0.25 times and 0.5 times of a wavelength of the first electromagnetic wave guided in the first rectangular waveguide.

* * * * *